United States Patent [19]

Suzuki

[11] 4,427,961

[45] Jan. 24, 1984

[54] CHIP TYPE HIGH FREQUENCY COIL DEVICE

[75] Inventor: Masato Suzuki, Hatoyama, Japan

[73] Assignee: Toko, Inc., Tokyo, Japan

[21] Appl. No.: 421,307

[22] Filed: Sep. 22, 1982

[30] Foreign Application Priority Data

Oct. 2, 1981 [JP] Japan ..... 56-147466[U]

[51] Int. Cl.[3] ..... H01F 15/02; H01F 15/04

[52] U.S. Cl. ..... 336/83; 336/84 R; 336/87; 336/136; 336/192

[58] Field of Search ..... 336/83, 84 R, 84 C, 336/87, 130, 132, 136, 90, 92, 192

[56] References Cited

U.S. PATENT DOCUMENTS 3,090,907 5/1963 Maeda ..... 336/83 X 3,601,734 8/1971 Chesney ..... 336/83

*Primary Examiner*—Thomas J. Kozma

[57] ABSTRACT

In a high frequency coil device including a drum core having a lower flange and a shield casing to be securely attached thereto, lugs are provided at the lower ends of a pair of opposing side walls of the shield casing; grooves are formed in a pair of opposing side walls of the lower flange; and the lower ends of those side walls of the shield casing which are provided with the lugs are located at a higher level than the lower ends of the remaining side walls of the shield casing which are provided with no lugs. The lugs are disposed in engagement with the aforementioned grooves and bent into contact with the lower flange. The lower ends of the side walls provided with the lugs are disposed in abutment with the upper surface of the lower flange, and inner surface portions, adjacent to the lower ends, of the side walls provided with no lugs are disposed in engagement with the other opposing side walls of the lower flange. In this way, the shield casing is securely attached to the drum core in such a manner that it can be prevented from being vertically displaced, through the engagement of the lower ends of the side walls with the upper surface of the lower flange and through the engagement of the bent lugs with the lower surface of the lower flange, and it can also be prevented from being horizontally displaced, through the engagement of the lugs with the grooves and through the engagement of the aforementioned inner surface portions of the shield casing with the side surfaces of the lower flange.

2 Claims, 5 Drawing Figures

CHIP TYPE HIGH FREQUENCY COIL DEVICE

BACKGROUND OF THE INVENTION

1. Field of the Invention

This invention relates to a chip type high frequency coil device including electrodes adapted for surface-connection with a circuit pattern provided on a substrate.

2. Description of the Prior Art

Recently, with the miniaturization of electronic components, so-called chip-type high frequency coil devices have been proposed which are provided with electrodes adapted for direct surface-connection with a circuit pattern formed on a substrate formed of a plastic or ceramic material. Generally, such coil devices are so small as to be contained in a cube each side of which is as short as about 4 to 5 mm, and thus they are attended with technical difficulties which have not been encountered with the conventional high frequency coil devices including a base member provided with terminal pins. Among such technical difficulties is one which is experienced in an attempt to securely attach the shield casing of the coil device.

Referring to FIG. 1, there is shown, in a side view, a shield casing for a conventional high frequency coil device including terminal pins. FIG. 2 is a schematic longitudinal sectional view of the conventional high frequency coil device. As will be seen from these figures, the shield casing 1 is fitted over a base member 4 formed of a plastic material, and provided with projections 3 which are formed by inwardly stamping opposite side walls 2 of the casing. The shield casing 1 is fixed to the base member 4 by disposing the projections 3 in engagement with the upper surface of the base member 4 having terminal pins planted therein, and by bending lugs into contact with the bottom surface of the base member 4 so that the latter is held between the projections 3 and the lugs 5. Indicated at 6 is a threaded portion with which is engaged a cap core 8 which is disposed in such a manner as to cover a winding portion 7 formed by winding a coil on a drum core placed on the base member 4. Denoted at 9 are lugs adapted to serve as ground electrodes.

However, difficulties are experienced in an attempt to employ the above-mentioned fixing procedure with respect to a chip type high frequency coil device which is miniaturized as mentioned above.

More specifically, in the case of a chip type high frequency coil device, since it is too small in size, no base member is provided, and the lower flange of a drum core formed of ferrite is arranged to serve as such a base member; thus, it is required that a shield casing be secured directly to the lower flange which is small and slippery. Moreover, the shield casing per se is so small that projections and lugs provided thereon are correspondingly small, and hence the shield casing cannot be completely fixed simply by holding the lower flange of the drum core between the projections and the lugs. Obviously, this may permit the shield casing to be displaced, and thus aggravate the drawback inherent with the chip type high frequency coil device that the characteristics thereof tend to become unstable due to the fact that the device is poor in respect of working accuracy and physical strength since it is too small. Therefore, it is the status quo that chip type high frequency coil devices wherein the inductance thereof is adjustable through the engagement of the cap core with the shield casing, have not yet predominantly been put to practical use.

SUMMARY OF THE INVENTION

Accordingly, it is an object of the present invention to provide a highly reliable chip type high frequency coil device by solving the aforementioned technical problems with the prior art, particularly by solving the problems with the conventional shield casing fixing procedure.

Briefly, according to an aspect of the present invention, there is provided a high frequency coil device including a bobbin or so-called drum core provided with a lower flange and having electrodes provided on the lower flange; a winding wound on the drum core; a cap core covering that portion of the drum core on which the winding is wound; a square-shaped shield casing provided with a threaded portion with which the cap core is directly engaged, characterized in that lugs are provided at the lower ends of a pair of opposing side walls of the shield casing, the lower ends being higher than the lower ends of the remaining pair of side walls provided with no lugs; the shield casing is placed on the lower flange of the drum core in such a manner that the lower ends of the side walls provided with the lugs are disposed in abutment with the upper surface of the lower flange and the lugs are disposed in engagement with grooves formed in opposing side surfaces of the lower flange; the lugs are bent into engagement with the lower surface of the lower flange; and those inside portions of the side walls provided with no lugs which are adjacent to the lower ends thereof are disposed in contact with the side surfaces of the lower flange, whereby the shield casing is securely attached to the lower flange of the drum core.

Other objects, features and advantages of the present invention will become apparent from the ensuing description taken in conjunction with the accompanying drawings.

DESCRIPTION OF THE PREFERRED EMBODIMENTS

Figure 1:
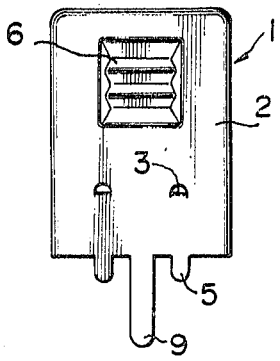
FIG. 1 PRIOR ART
FIG. 1 is a schematic side view showing the shield casing of a conventional high frequency coil device.
Figure 2:
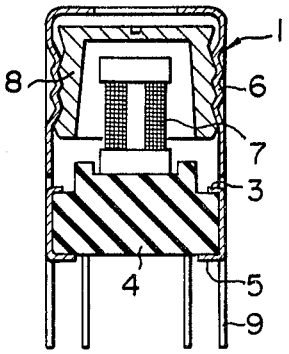
FIG. 2 PRIOR ART
FIG. 2 is a schematic longitudinal sectional view of the conventional high frequency coil device shown in FIG. 1.
Figure 3:
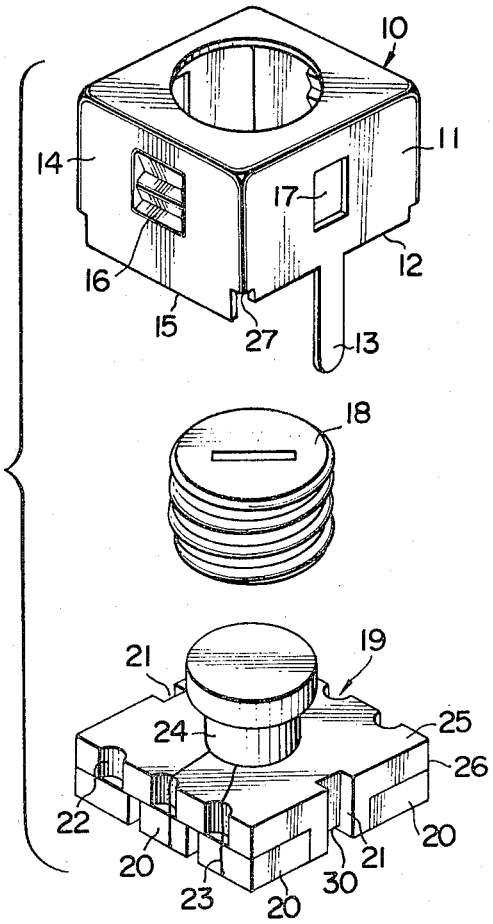
FIG. 3 is an exploded perspective view showing the high frequency coil device according to an embodiment of the present invention.
Figure 4:
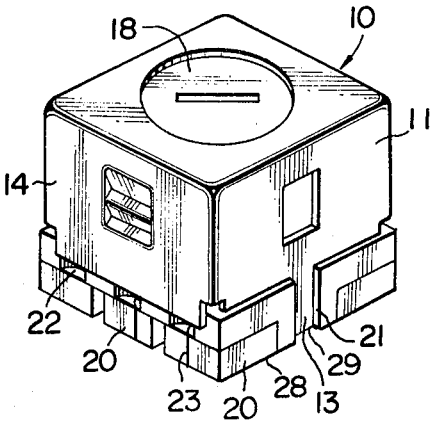
FIG. 4 is a perspective view showing the device of FIG. 3 in an assembled state.

The present invention will first be described with reference to FIGS. 3, 4 and 5 which illustrate the chip type high frequency coil device according to an embodiment of the present invention. FIG. 3 is an exploded perspective view showing the coil device; FIG. 4 is a perspective view showing the device of FIG. 3 in an assembled state; and FIG. 5 is a bottom view of FIG. 4.

Figure 5:
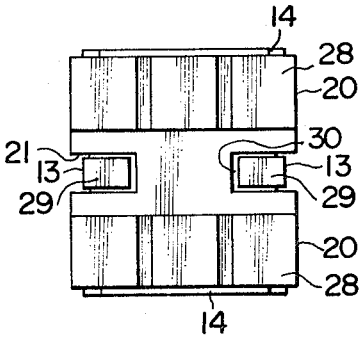
FIG. 5 is a bottom view of FIG. 4.

The chip type high frequency coil device shown in FIGS. 3, 4 and 5 includes a square-shaped shield casing 10, a cap core 18 having an externally threaded portion formed on the peripheral surface thereof; and a drum core 19 including a square-shaped lower flange 26 having a plurality of plate-like electrodes 20 provided on the bottom surface thereof.

The lower ends of the respective side walls of the shield casing 10, except for the lower ends 27 of the four corners, are located in such a manner that the lower ends of the side wall 11 and that of the opposite side wall lie in a common horizontal plane while the lower end of the side wall 14 and that of the opposite side wall lie in another horizontal plane.

Lugs 13 are provided at the lower ends of the side wall 11 and opposite one, respectively, and the lower ends 12 are located at a higher level than the lower ends 15 of the side wall 14 and opposite one which are provided with no lugs. Furthermore, each of the side wall 14 and opposite one is provided with an internally threaded portion 16, and each of the side wall 11 and opposite one is formed with a rectangular pressing portion 17. The cap core 18 is arranged to be held in the shield casing while having the externally threaded portion thereof disposed in intermeshing relationship with the internally threaded portions 16 and having the peripheral surface thereof pressed by the pressing portions 17. The lower ends 27 of the four corners of the shield casing are located at a higher level than the lower ends 12 and 15, and such an arrangement is preferred in order to permit these four corners to be worked by using other tools than those employed to form the side walls 11 and 14 since the working accuracy of the four corners tends to be decreased when the shield casing 10 is formed. However, it is to be understood that the aforementioned configuration of the four corners of the shield casing is employed simply from the working standpoint and not essential to the construction of the present invention. Thus, no problems will arise if the lower ends of the four corners are located either in the horizontal plane in which the lower ends 15 lie or the horizontal plane in which the other lower ends 12 lie.

In a pair of opposite side surfaces of the lower flange 26 of the drum core are respectively formed grooves 21 which are adapted so that the lugs 13 of the shield casing are fitted therein, and in another pair of opposite side surfaces of the lower flange 26 of the drum core are respectively formed grooves 22 which are adapted to permit lead wires 23 of the winding portion 24 to be led out and extended so as to be connected to the electrodes 20. The bottom surface of the lower flange 26 and the side surfaces thereof where the grooves 22 are formed, are partly cut out so that there are formed cut-out portions of a substantially right-angle cross-section to which the plurality of substantially plate-like electrodes 20 are securely attached by means of an adhesive agent. The lead wires 23 are soldered to the electrodes 20 as mentioned above. A bottom surface portion 30 of the lower flange is recessed, at the lower ends of the grooves 21, by an amount corresponding substantially to the thickness of the lugs 13.

As shown in FIG. 4, the shield casing 10 having the cap core 18 intermeshed therewith is fixedly mounted onto the drum core 19 constructed as mentioned above.

More specifically, the lower ends 12 of those side walls of the shield casing which are provided with the lugs 13, are disposed in abutment with the upper surface 25 of the lower flange 26, with the lugs 13 disposed in engagement with the grooves 21 of the lower flange. The lugs 13 are bent into contact with the bottom surface of the lower flange 26 so that the shield casing 10 is thereby securely attached to the drum core 19. The lugs 13 are also adapted to serve as ground electrodes. Inner surface portions, adjacent to the lower ends 15, of those side walls of the shield casing which are provided with no lugs, are disposed in engagement with those side surfaces of the lower flange 26 which are formed with the grooves 22. Bottom surfaces 28 of the electrodes 20, and surfaces 29 of the lugs 13 present on the bottom surface of the lower flange 26 are substantially flush with each other. In this way, the shield casing 10 is prevented from being vertically displaced, by virtue of the fact that the lower flange 26 is held between the lower ends 12 and those portions of the lugs which are bent contact with the bottom surface of the lower flange 26, and it is also prevented from being horizontally displaced, by virtue of the fact that the side surfaces of the lower flange 26 are retained by the inner surface portions, adjacent to the lower ends 15, of the shield casing and the lugs 13 disposed in engagement with the grooves 21.

As will be appreciated from the above discussion, with the chip type high frequency coil device embodying the present invention, the shield casing 10 is completely secured to the lower flange 26 of the drum core, by utilizing the entire lower end portions thereof. Since the shield casing 10 is in contact with the lower flange 26 at the lower ends 12, the lugs 13, and the inner surface portions adjacent to the lower ends 15, a wider contact area is secured therebetween so that the shield casing 10 is fixed much more stably than the conventional shield casing which was arranged to be fixed by holding a base member between projections or the like provided thereon. Thus, the positional relationship between the cap core 18 and the winding portion 24 is stabilized so that the inductance of the present coil device is stably adjustable.

Although in the above-described embodiment, the lugs 13 were made to serve also as ground electrodes, it is also possible surfaces 28 of the electrodes 20 and employed only for the purpose of securely attaching the shield casing 10 to the drum core 19. Furthermore, although the lower ends 15 of the side wall 14 and opposite one were made to lie in the common horizontal plane, such lower ends may be made to lie in different horizontal planes. Still furthermore, although in the foregoing embodiment, a single winding was provided and thus only two leads 23 were shown, it is also possible that two or more windings may be provided, and in such a case, it goes without saying that more than two leads are connected to the electrodes 20.

While the present invention has been described and illustrated in connection with specific embodiments, it is to be understood that the present invention is by no means limited thereto but covers all changes and modifications which will become possible within the scope of the appended claims.

What is claimed is:

1. A high frequency coil device, comprising a drum core having a square-shaped lower flange, electrodes provided on the bottom surface of said lower flange, a winding or windings wound on said drum core, a cap core covering the winding portion of said drum core, a square-shaped shield casing having a threaded portion with which said cap core is directly intermeshed, wherein lugs are provided at the lower ends of a pair of opposing side walls of the shield casing; said lower ends are located at a higher level than the lower ends of another pair of side walls of the shield casing which are provided with no lugs; the lower ends of those side walls of the shield casing which are provided with the lugs, are disposed in abutment with the upper surface of said lower flange of said drum core; said lugs are disposed in engagement with grooves formed in said surfaces of said lower flange and bent into contact with the bottom surface of the lower flange; and inner surface portions, adjacent to the lower ends, of those side walls of the shield casing which are provided with no lugs, are disposed in engagement with the side surfaces of the lower flange, whereby the shield casing is securely attached to the lower flange of the drum core.

2. A high frequency coil device according to claim 1, wherein the lower ends of the four corners of the shield casing are located at a higher level than the lower ends of those side walls of the shield casing which are provided with the lugs.

* * * * *